US006742556B1

(12) United States Patent
Osuna et al.

(10) Patent No.: US 6,742,556 B1
(45) Date of Patent: Jun. 1, 2004

(54) FILLER VALVE ASSEMBLY

(75) Inventors: Marco A. Osuna, Manteca, CA (US); James Gonsalves, Oakland, CA (US)

(73) Assignee: Stokley-Van Camp, Inc.

( * ) Notice: Subject to any disclaimer, the term of this patent is extended or adjusted under 35 U.S.C. 154(b) by 0 days.

(21) Appl. No.: 10/424,973

(22) Filed: Apr. 28, 2003

Related U.S. Application Data

(60) Provisional application No. 60/435,473, filed on Dec. 19, 2002.

(51) Int. Cl.[7] ..... B65B 1/04

(52) U.S. Cl. ..... 141/301; 141/146; 141/264

(58) Field of Search ..... 141/129, 146, 141/144, 286–302, 263, 264

(56) References Cited

U.S. PATENT DOCUMENTS

| | | | | |
|---|---|---|---|---|
| 2,622,612 A | | 12/1952 | Manhartsberger | |
| 2,640,630 A | | 6/1953 | Genco | |
| 2,839,094 A | * | 6/1958 | Reno | 141/84 |
| 3,263,711 A | * | 8/1966 | Herman | 141/40 |
| 3,415,427 A | | 12/1968 | Sharp | |
| 4,073,414 A | | 2/1978 | Garab | |
| 4,300,750 A | | 11/1981 | Valka et al. | |
| 4,349,055 A | | 9/1982 | DiChiara | |
| 4,363,424 A | | 12/1982 | Holben et al. | |
| 4,363,429 A | | 12/1982 | Schindler | |
| 4,492,259 A | | 1/1985 | Sick et al. | |
| 4,903,740 A | | 2/1990 | Corniea et al. | |
| 4,958,668 A | | 9/1990 | Vachon | |
| 5,025,991 A | | 6/1991 | Stainbrook et al. | |
| 5,071,038 A | | 12/1991 | Credle, Jr. | |
| 5,181,631 A | | 1/1993 | Credle, Jr. | |
| 5,240,144 A | | 8/1993 | Feldman | |
| 5,402,914 A | | 4/1995 | Zapp | |
| 5,425,404 A | | 6/1995 | Dyer | |
| 5,449,023 A | | 9/1995 | Cleland et al. | |
| 5,564,481 A | | 10/1996 | Clusserath | |
| 5,655,690 A | | 8/1997 | DeGoler et al. | |
| 5,862,961 A | | 1/1999 | Motta et al. | |
| 5,862,996 A | | 1/1999 | Crichton | |
| 6,112,778 A | | 9/2000 | Nish et al. | |
| 6,152,195 A | | 11/2000 | Persenaire | |
| 6,378,574 B2 | | 4/2002 | Tsutsui | |
| 6,390,148 B2 | * | 5/2002 | Martin | 141/39 |

* cited by examiner

*Primary Examiner*—Steven O. Douglas
(74) *Attorney, Agent, or Firm*—Cook, Alex, McFarron, Manzo, Cummings & Mehler, Ltd.

(57) ABSTRACT

A filler valve assembly that includes a first housing member with an elongated hollow filler tube secured thereto, the filler tube having an outlet through which liquid exits when filling containers. A second housing member having secured thereto an elongated piston with an enlarged end portion is provided so that the elongated piston is disposed interior of the filler tube. The piston is axially moveable with respect to the filler tube to move the enlarged portion of the piston from a first, closed position to a second, open position. When in the closed position, a substantially liquid-tight seal is formed between the outlet of the filler tube and the enlarged portion of the piston, both the outlet and the enlarged portion being formed of a metal so that the seal is formed solely by metal-to-metal contact.

5 Claims, 2 Drawing Sheets

FILLER VALVE ASSEMBLY

CROSS REFERENCE TO RELATED APPLICATION

This application claims the benefit of the filing date of U.S. provisional patent application No. 60/435,473, filed Dec. 19, 2002.

BACKGROUND OF THE INVENTION APPLICATION

The present invention relates to container filling machines and, more particularly, to a filler valve assembly for dispensing a liquid into containers that are placed against the filler valve.

Container filling machines typically include a plurality of filler valve assemblies that dispense liquid into individual containers as they pass under the valve assemblies. The filler valve assemblies usually include a filler tube that extends into the interior of the container to be filled when the container is aligned with the filler valve. The filler valve assembly may include a central plunger or piston that is moveable axially within the filler tube to open and close the valve. See e.g., U.S. Pat. No. 5,564,481 to Clüsserath and U.S. Pat. No. 6,152,195 to Persenaire.

As shown in the above-referenced patents, the central plunger or piston seats against the inner wall of the filler tube to close the valve and prevent liquid from exiting the filler tube. Such valves typically include separate gaskets on one or both of the filler tube and plunger/piston to seal the filler valve when it is closed. Over time, such gaskets wear or can become otherwise damaged such that they may be dislodged from their seats in the valve. This can create a particular problem if the gasket is discharged into a container that is being filled by the valve. If a gasket is determined to be missing, the production line must be shut down. The containers filled during that production run are examined in an attempt to locate the missing gasket and to ensure that a container containing the gasket does not find its way to the consuming public, where it could possibly be ingested. Such inspections are time consuming and frequently unsuccessful, which could result in the unnecessary disposal of filled containers in order to avoid the possibility of tainted product.

Accordingly, it is an object of the present invention to provide a filler valve assembly in which the outlet of the filler tube is effectively sealed without the use of separate gaskets that could be dislodged from the filler valve.

SUMMARY OF THE INVENTION

This object, as well as others which will become apparent upon reference to the following detailed description and accompanying drawings, is accomplished by a filler valve assembly that includes a first housing member with an elongated hollow filler tube secured thereto, the filler tube having an outlet through which liquid exits when filling containers. A second housing member having an elongated piston with an enlarged end portion secured thereto is provided so that the elongated piston is disposed interior of the filler tube. The piston is axially moveable with respect to the filler tube to move the enlarged portion of the piston from a first, closed position in which the enlarged portion engages the outlet of the filler tube to block the flow of liquid out from the filler tube, and a second, open position in which the enlarged portion is spaced away from the outlet of the filler tube to permit the flow of liquid out from the filler tube.

When in the closed position, a substantially liquid-tight seal is formed between the outlet of the filler tube and the enlarged portion of the piston, both the outlet and the enlarged portion being formed of a metal so that the seal is formed solely by metal-to-metal contact.

Preferably, the enlarged portion of the piston has a shoulder formed at an angle, and the outlet of the filler tube has an internal relief formed at a similar angle, so that, when in the closed position, the seal is formed by the engagement of the shoulder on the piston with the relief on the filler tube outlet. In the preferred embodiment, the angle is 17 degrees.

In another aspect of the invention, the enlarged portion of the piston is made of a metal that is relatively harder than the metal comprising the outlet of the filler tube.

DETAILED DESCRIPTION

Figure 1:
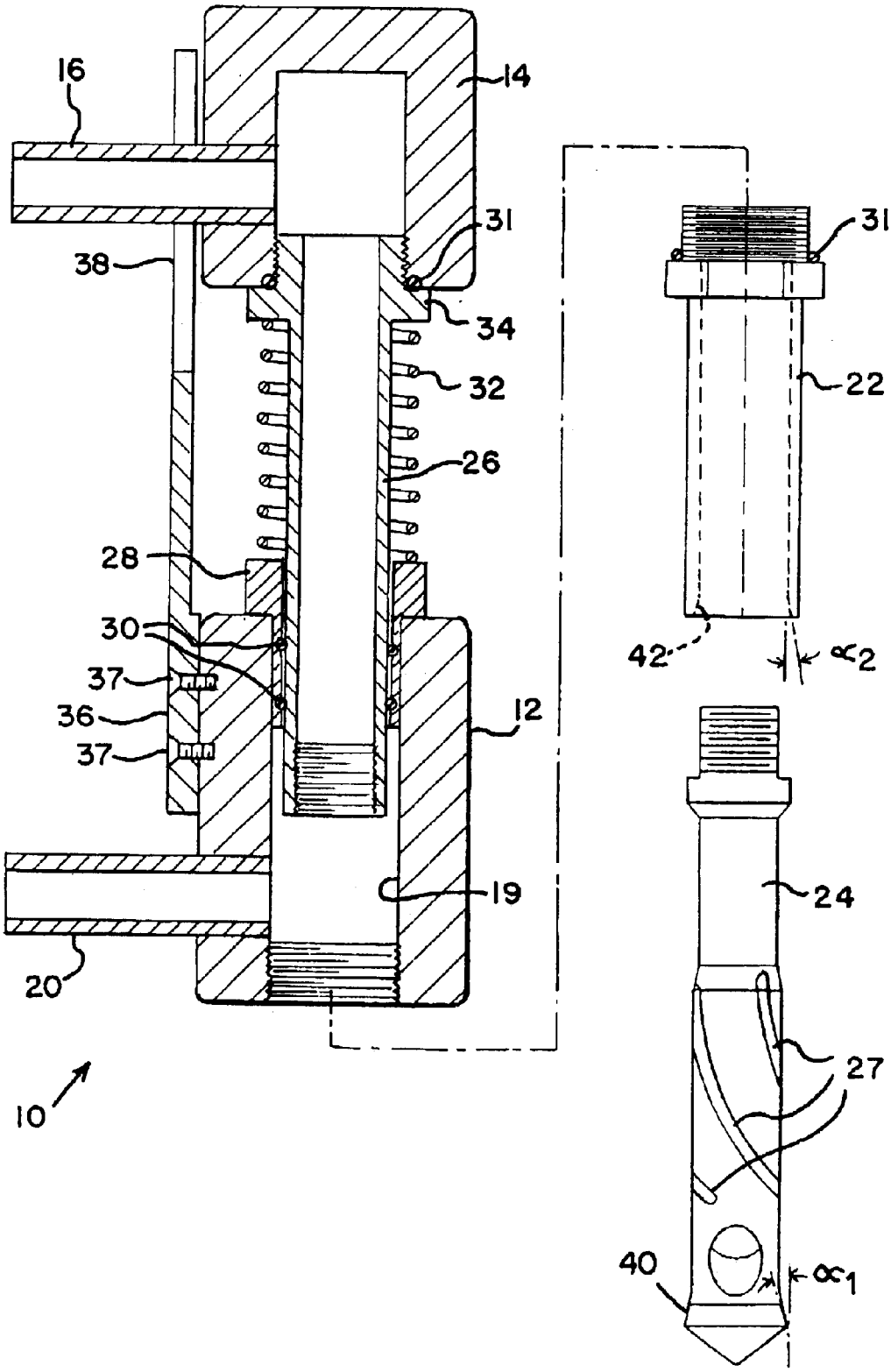
FIG. 1 is an exploded view, in partial cross-section, of a filler valve assembly according to the present invention.

With reference to the drawings, there is seen a filler valve assembly, generally designated 10, in accordance with the present invention. Such a filler valve assembly is usable with well-known filing machines, such as those manufactured by U.S. Bottlers Machinery Co. of Charlotte, N.C. A general understanding of filling machines can be obtained by reference to the Clüsserath, U.S. Pat. No. 5,564,481, identified above, which is incorporated by reference herein.

The component parts of the filler valve assembly are typically made of stainless steel or other durable, non-corrosive materials. The assembly 10 includes lower and upper housing members 12, 14, respectively. The housing members 12, 14 are moveable with respect to each other in order to open and close the valve assembly 10. The upper housing member 14 includes an inlet 16 for receiving the fluid that is to be dispensed into a container 18, shown in phantom, while the lower housing member 12 includes a central through-bore 19 and a fluid outlet 20 through which fluid exits the valve assembly 10 when the container is filled.

A stainless steel filler tube 22 having an open central bore extends downwardly from the lower housing member 12. The central bore of the filler tube 22 slidingly receives a central plunger or piston 24, also of stainless steel, that is secured by means of a tubular extension 26 to the upper housing member 14. A preferred stainless steel for the filler tube 22 and central piston 24 is set forth in the accompanying Table I.

TABLE I

| INGREDIENTS/CAS# | WT. % |
|---|---|
| Iron 1309-37-1 | 65.50 |
| Chromium 7440-47-3 | 16.80 |
| Nickel 7440-02-0 | 11.30 |
| Molybdenum 7439-98-7 | 2.10 |
| Manganese 7439-96-5 | 2.00 |
| Copper 7440-50-8 | .80 |
| Cobalt 7440-48-4 | .70 |

A stainless steel having such a composition is available from Carpenter Technology Corporation of Reading, Pennsylvania, as "316" stainless steel.

The exterior of the piston 24 includes a plurality of equally-spaced helical flutes 27 for facilitating the flow of liquid back to the interior of the lower housing when the container is filled.

A bushing 28, preferably having a synthetic fluorine (Teflon) coating, is received within the upper end of the through-bore 19 in the lower housing 12. The bushing 28 seats two O-ring gaskets 30 that provide a fluid seal between the lower housing 12 and the tubular extension 26 for the central piston 24. Similarly, O-rings 31 provide a fluid seal between the upper housing 14/tubular extension 26 and the lower housing 12/filler tube 22.

Figure 2:
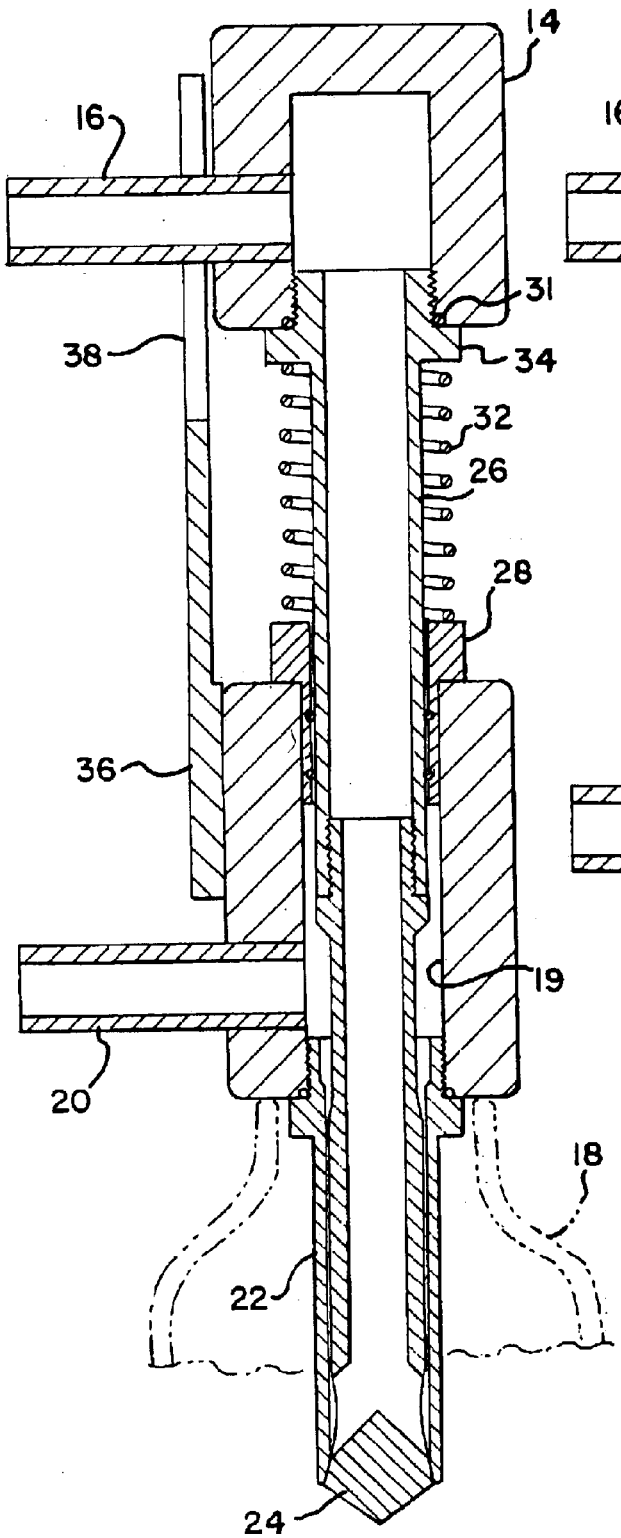
FIG. 2 is a cross-sectional view of the filler valve assembly of FIG. 1 with the valve in its "closed" position.
Figure 3:
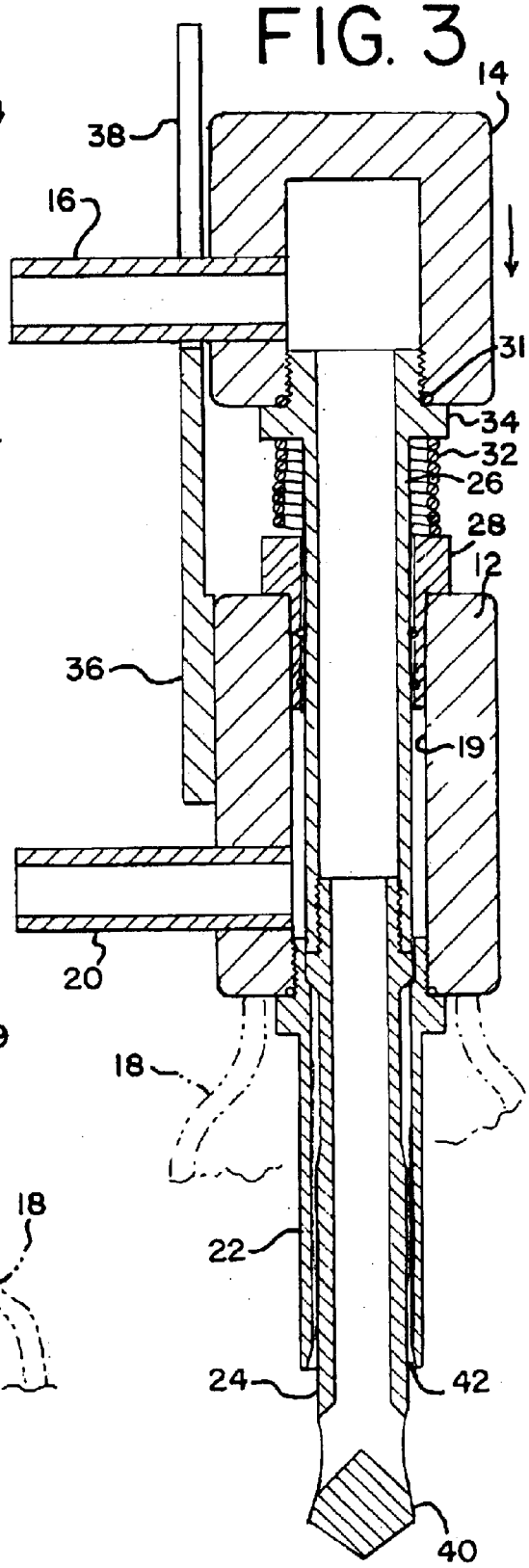
FIG. 3 is a cross-sectional view of the filler valve assembly of FIG. 1 with the valve in its "open" position.

A spring 32 nests over the tubular extension 26 between the bushing 28 and a flange 34 on the filler tube 26 to bias the valve assembly 10 to the "closed" position, as shown in FIG. 2. Rotational movement of the upper and lower housing members 12, 14 with respect to each other is limited by means of a generally Y-shaped fork or yoke 36. As illustrated, the yoke 36 is secured to the lower housing member by two screws 37, with the inlet 16 on the upper housing member 14 being captured between the two divergent arms 38 (one arm shown) of the yoke 36.

In keeping with the invention, a fluid-tight seal is provided between the lower end of the central piston 24 and the opening/exit in the filler tube 22 when the valve assembly 10 is in its closed position without the use of any additional separate seals or gaskets. To this end, the lower end of the central piston 24 is provided with an enlarged shoulder 48 that flares outwardly from the piston at an angle $\alpha_1$ of 17 degrees. When the valve assembly is in the closed position, the shoulder 40 seats in a fluid-tight fashion against the interior of the opening of the filler tube 22, which has a relief 42 of an identical angle $\alpha_2$ of 17 degrees. A seal is obtained between the shoulder 40 on the central piston 24 and the relief 42 on the filler tube 22, due to the precise machining of the angles $\alpha_1$ and $\alpha_2$.

In the preferred embodiment, the hardness of the stainless steel of the central piston 24 is greater than the hardness of the stainless steel of the filler tube 22. As a consequence, with use the shoulder 40 of the control piston 24 will cause wear on the softer filler tube 22 in a manner that results in the interfacing parts to more completely conform to each other, thus further enhancing the seal between the piston 24 and filler tube 22 when the valve is in the closed position.

Thus, a filler valve assembly has been provided that meets the object of the present invention. While the invention has been described in the context of a preferred embodiment, there is no intent to limit it to the same. Instead, the invention is defined by the following claims.

What is claimed:

1. A filler valve assembly for use in a filling machine for filling containers comprising:

a first hollow member;

an elongated hollow filler tube secured to the first housing member and having an outlet through which liquid exits when filling containers;

a second housing member;

an elongated piston having an enlarged portion secured to the second housing member and disposed interior of the filler tube, the piston being axially moveable with respect to the filler tube to move the enlarged portion of the piston from a first position, in which the enlarged portion engages the outlet of the filler tube to form a substantially liquid-tight seal, to block the flow of liquid out from the filler tube, to a second position, in which the enlarged portion is spaced away from the outlet of the filler tube to permit the flow of liquid out from the filler tube;

the outlet of the filler tube and the enlarged portion of the piston being formed of a metal so that the substantially liquid-tight seal is formed solely by metal-to-metal contact between the filler tube outlet and the enlarged portion of the piston.

2. The filler valve assembly of claim 1 wherein the enlarged portion of the piston is a shoulder formed at an angle $\alpha$ with respect to the axis of the piston and the outlet of the filler tube has an internal relief formed at an angle $\alpha$ with respect to the axis of the filler tube so that, when in the closed position, the substantially liquid-tight seal is formed by the engagement of the shoulder on the piston with the relief on the filler tube outlet.

3. The filler valve assembly of claim 2 wherein the angle $\alpha$ is 17 degrees.

4. The filler valve assembly of claim 1 wherein the enlarged portion of the piston comprises a metal that is relatively harder than the metal comprising the outlet of the filler tube.

5. The filler valve assembly of claim 1 wherein the filler tube and the piston are made of stainless steel.

* * * * *

UNITED STATES PATENT AND TRADEMARK OFFICE

CERTIFICATE OF CORRECTION

PATENT NO. : 6,742,556 B1
DATED : June 1, 2004
INVENTOR(S) : Marco A. Osuna and James Gonsalves It is certified that error appears in the above-identified patent and that said Letters Patent is hereby corrected as shown below:

Title page,
Item [73], Assignee, delete "Stokley-Van" insert -- Stokely-Van --.

Signed and Sealed this

Thirtieth Day of November, 2004

JON W. DUDAS
*Director of the United States Patent and Trademark Office*